US005484146A

United States Patent [19]

Loschiavo

[11] Patent Number: 5,484,146

[45] Date of Patent: Jan. 16, 1996

[54] HOCKEY BLADE WEIGHT MEMBER

[76] Inventor: Mark A. Loschiavo, 924 Clyde La., Philadelphia, Pa. 19128

[21] Appl. No.: 391,362

[22] Filed: Feb. 21, 1995

[51] Int. Cl.[6] ..... A63B 59/12; A63B 21/00; A63B 69/00

[52] U.S. Cl. ..... 273/67 A; 273/194 B

[58] Field of Search ..... 273/67 R, 67 A, 273/67 DB, 194 A, 194 B

[56] References Cited

U.S. PATENT DOCUMENTS

| | | | |
|---|---|---|---|
| 2,950,919 | 8/1960 | Cadman | 273/194 B |
| 3,133,735 | 5/1964 | Greenshields | 273/194 B X |
| 3,834,697 | 9/1974 | McNamara, Jr. et al. | 273/67 A X |
| 4,364,560 | 12/1982 | Gemmel | 273/67 A X |
| 4,491,320 | 1/1985 | Smith | 273/67 A |

FOREIGN PATENT DOCUMENTS

| | | | |
|---|---|---|---|
| 2269757 | 2/1994 | United Kingdom | 273/194 B |

*Primary Examiner*—Raleigh W. Chiu

[57] ABSTRACT

The hockey blade weight member of the invention employs a snap-on member having a weight portion arranged for contiguous communication with a rear surface of a hockey blade and a forward clamping portion to engage a forward wall of the hockey blade, wherein an alternative configuration of the invention further employs a flange member arranged to extend from the weight portion of the weight member along the handle to enhance securement of the weight member to the hockey stick.

4 Claims, 3 Drawing Sheets

HOCKEY BLADE WEIGHT MEMBER

TECHNICAL FIELD

The field of invention relates to sporting equipment, and more particularly to a hockey blade weight arranged for secured attachment to a blade of a hockey stick for use in practice in the handling and shooting relative to a hockey game to enhance ease of manipulation of the stick in use.

BACKGROUND OF THE INVENTION

Prior art structure relative to sporting equipment and weight attachment structure is typically limited to baseball bats and the like, wherein a doughnut-like ring member is slidingly mounted onto a baseball bat to provide for an individual to improve handling and manipulation of such a bat structure.

SUMMARY OF THE INVENTION

The hockey blade weight member of the invention employs a snap-on member having a weight portion arranged for contiguous communication with a rear surface of a hockey blade and a forward clamping portion to engage a forward wall of the hockey blade, wherein an alternative configuration of the invention further employs a flange member arranged to extend from the weight portion of the weight member along the handle to enhance securement of the weight member to the hockey stick.

Objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein; however, it is to be understood that the disclosed embodiments are merely exemplary of the invention, which may be embodied in various forms therefore, specific structural and functional details disclosed herein are not to be interpreted as limiting, but merely as a basis for the claims and as a representative basis for teaching one skilled in the art to variously employ the present invention in virtually any appropriately detailed structure.

Figures 1, 2:
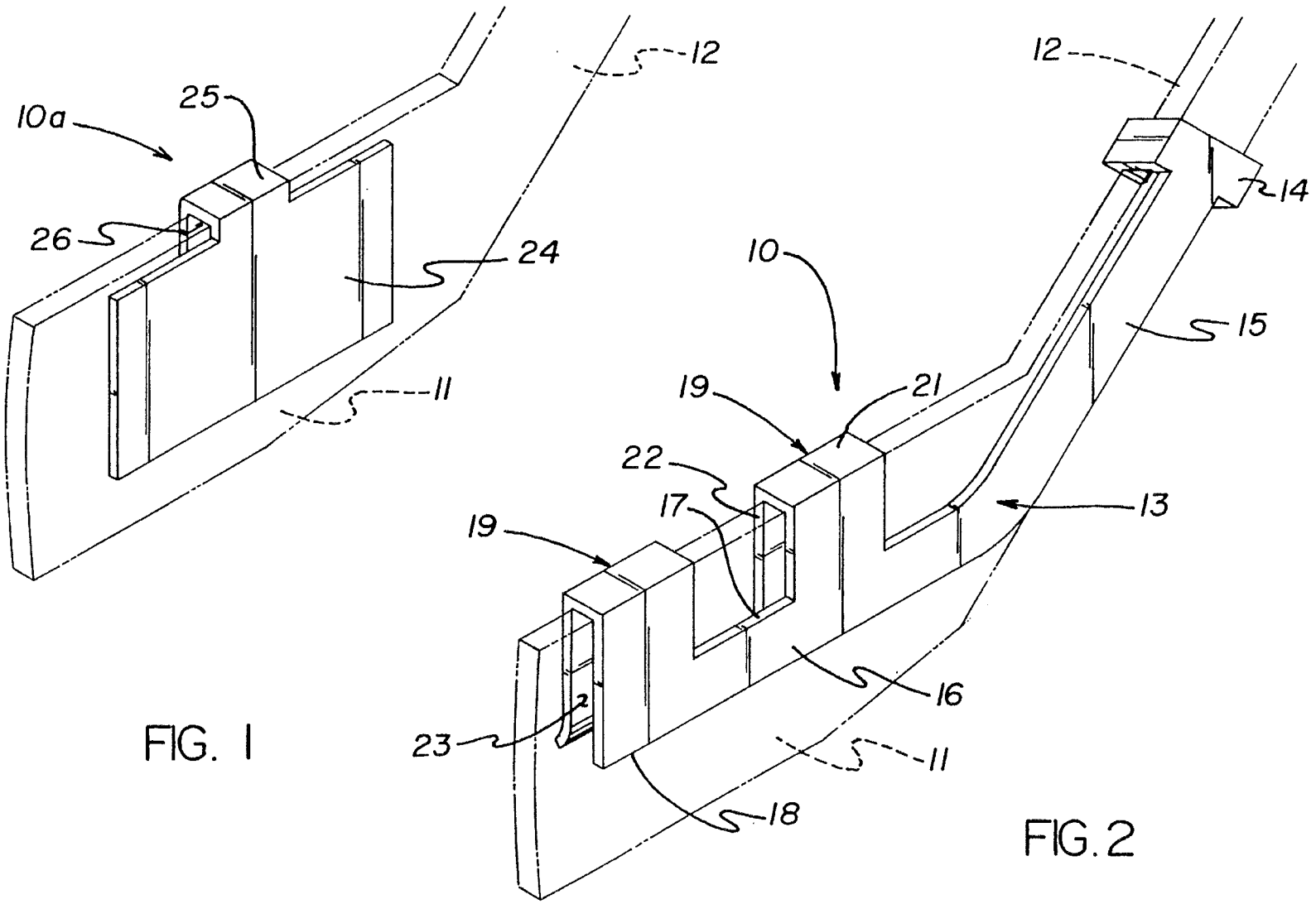
FIG. 1 is a perspective illustration of a practice weight member employing an aspect of the invention.
FIG. 2 is a perspective illustration of an alternative manner of the weight of the invention retrofitted to a hockey blade member.

The hockey blade weight member 10, such as indicated in FIG. 2, is arranged for mounting to a hockey blade 11 having a blade rear wall spaced from a blade front wall. The blade includes a handle 12 extending therefrom in a conventional manner.

The weight member 10 comprises an arcuate flange 13 having spaced planar flange rear and forward walls, with the forward wall arranged to engage the handle 12 as well as the blade rear wall. The flange 13 to this end employs a flange first leg 15 integral with a flange second leg 16 joined together at an oblique orientation relative to one another, such as indicated in FIG. 2, and typically at an obtuse angulation relative to one another. A C-shaped clamp 14 is integral with the arcuate flange 13 at its distal end spaced from the flange second leg 16, with the C-shaped clamp of a resilient and flexible construction permitting it to substantially encircle the associated handle 12, with the C-shaped clamp 14 of discontinuous construction permitting reception of the handle 12 within the C-shaped clamp structure. The second leg 16 further includes a first side 17 spaced from a second side 18, with at least one and typically a plurality of U-shaped spring clamp members 19 extending from the first side 17. Each of the clamp members 19 employs a clamp member first flange 20, such that the clamp member's first flange 20 is oriented substantially orthogonally to the first side 17 terminating to a clamp member second flange 21 substantially orthogonally and typically obliquely oriented and integral with the clamp member's first flange 20, and a clamp member third flange 22 extends from the clamp member second flange 21, such that the clamp member third flange 22 is arranged in a facing, spring-biased relationship to the clamp member first flange 20, such that a gap 23 defined within each of the U-shaped clamp members 19 receives the hockey blade 11 therewithin in a clamping relationship.

Figure 3:
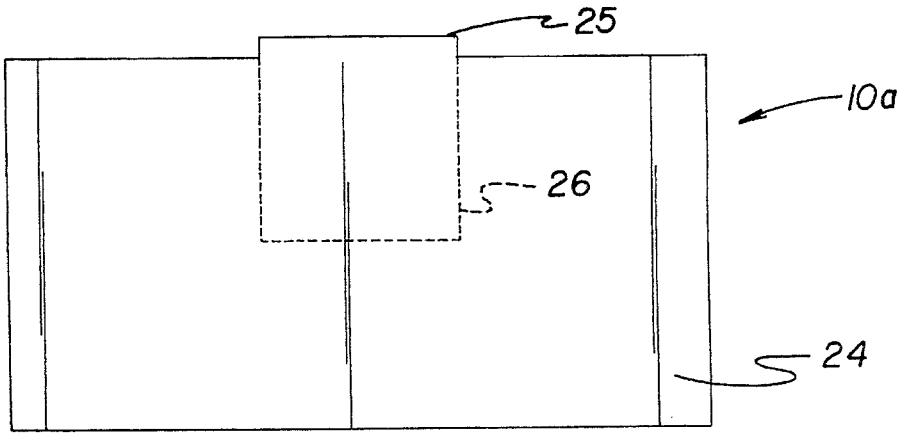
FIG. 3 is a frontal view, taken in elevation, of the weight member as indicated in FIG. 1.
Figure 4:
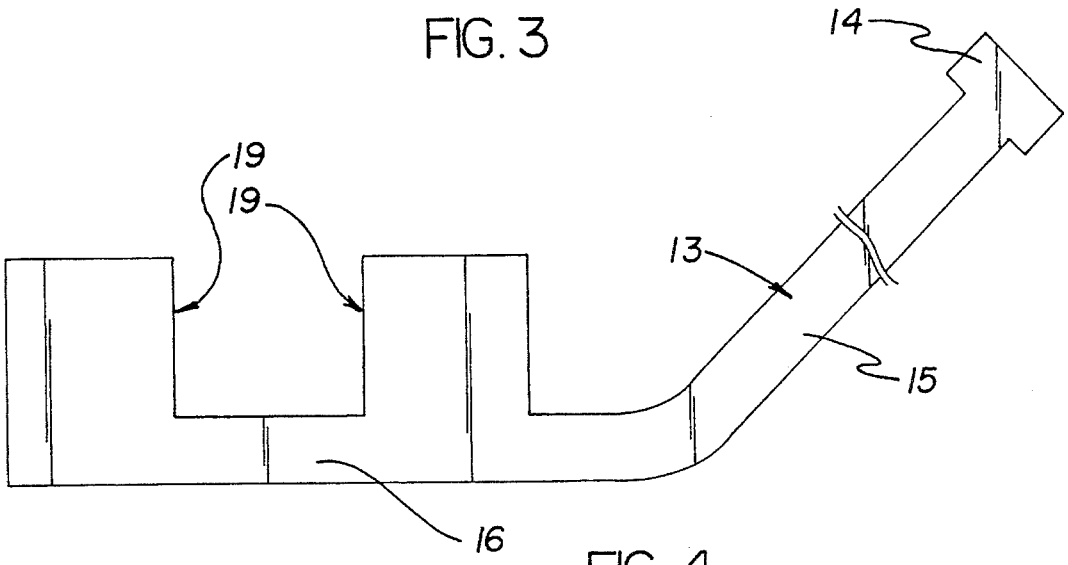
FIG. 4 is an elevational view of a rear portion of the weight member as indicated in FIG. 3.
Figure 5:
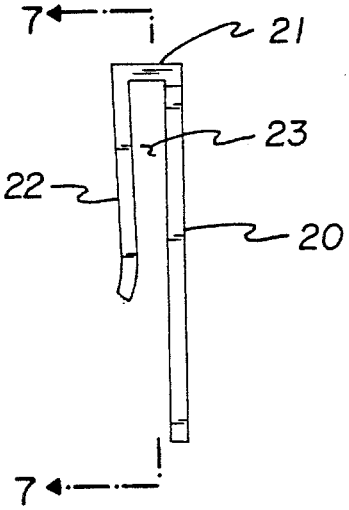
FIG. 5 is an end view of the weight member as indicated in FIG. 4.
Figure 6:
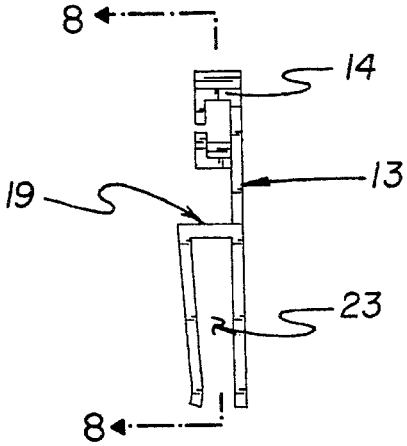
FIG. 6 is an end view of the weight member indicating the associated mounting flange structure.
Figure 7:
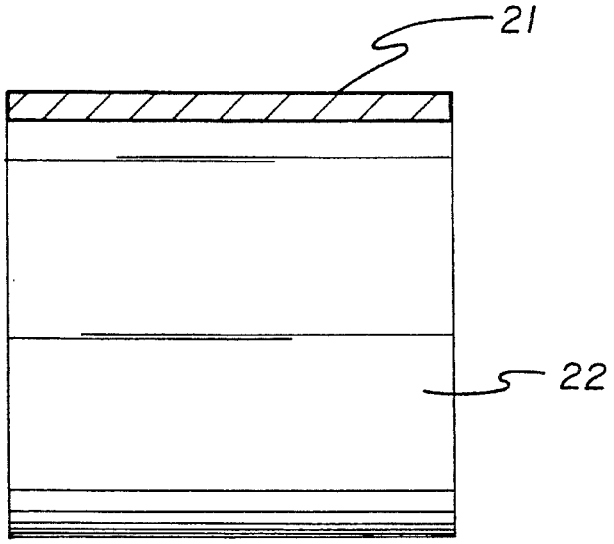
FIG. 7 is a cross-sectional illustration taken along the lines 7—7 of FIG. 5 as indicated.
Figure 8:
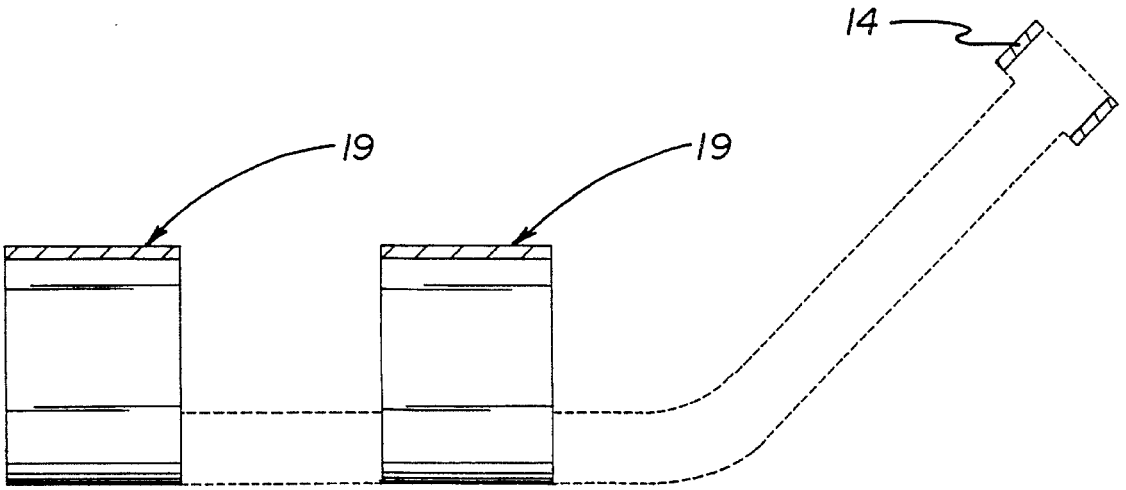
FIG. 8 is a cross-sectional illustration taken along the lines 8—8 of FIG. 6 as indicated.

As an alternative, the weight member 10*a*, such as indicated in the FIGS. 1 and 3 for example, employs a facial plate 24 arranged to engage the hockey blade rear wall, such that the facial plate has a facial plate first flange 25 extending from the facial plate extending to a facial plate second flange 26, such that a gap portion of the spacing of the second flange relative to the facial plate engages the hockey blade. Advantages of the invention 10, such as indicated in FIG. 2, enhances securement of the weight member to the hockey blade minimizing need for adhesive securement and attachment of the weight member thereto.

The invention is employed to strengthen and enhance ease of manipulation of the hockey stick structure and is arranged for removal subsequent to game play.

It is to be understood that while certain forms of the present invention have been illustrated and described herein, it is not to be limited to the specific forms or arrangement of parts described and shown.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed and desired to be protected by Letters Patent of the United States is as follows:

1. A hockey blade weight member arranged for attachment to a hockey stick, having a hockey blade and a handle extending from the hockey blade, and wherein the weight member comprises, a flange member, the flange member having a flange front wall spaced from a flange rear wall, and the flange member having a first side spaced from a second side, with at least one U-shaped spring clamp member extending from the first side, the spring member having a gap oriented between the flange member and the flange front wall to receive the hockey blade therewithin.

2. A weight member as set forth in claim 1 wherein the flange member includes a first leg having the at least one U-shaped spring clamp member extending therefrom, with a flange second leg extending from the flange first leg, the flange first leg and the flange second leg integrally secured relative to one another and joined at an oblique orientation relative to one another, with the flange second leg arranged for extension along the hockey stick handle, and the flange second leg having a distal end spaced from the flange first leg, and the distal end having a generally C-shaped clamp member of resilient construction arranged to receive the hockey handle therewithin.

3. A weight member as set forth in claim 2 wherein said at least one said U-shaped spring clamp member includes a first flange extending from the flange first side, and a clamp member second flange obliquely and integrally secured to the clamp member first flange and a clamp member third flange extending obliquely and integrally to the clamp member second flange, with the clamp member third flange arranged in a facing spring-biased relationship relative to the clamp member first flange and to the flange second leg.

4. A weight member as set forth in claim 3 including a second U-shaped spring clamp member extending from the flange first side.

* * * * *